US011466414B2

(12) United States Patent
Hughes, Jr.

(10) Patent No.: US 11,466,414 B2
(45) Date of Patent: Oct. 11, 2022

(54) TRAFFIC CONTROL MARKER INCLUDING A REINFORCING MEMBER

(71) Applicant: Robert K. Hughes, Jr., Fort Myers, FL (US)

(72) Inventor: Robert K. Hughes, Jr., Fort Myers, FL (US)

( * ) Notice: Subject to any disclaimer, the term of this patent is extended or adjusted under 35 U.S.C. 154(b) by 0 days.

(21) Appl. No.: 16/281,637

(22) Filed: Feb. 21, 2019

(65) Prior Publication Data

US 2019/0257044 A1 Aug. 22, 2019

Related U.S. Application Data

(60) Provisional application No. 62/633,189, filed on Feb. 21, 2018.

(51) Int. Cl.

| | |
|---|---|
| ***E01F 9/608*** | (2016.01) |
| ***E04H 12/22*** | (2006.01) |
| ***E01F 9/627*** | (2016.01) |
| *E01F 9/615* | (2016.01) |

(52) U.S. Cl.

CPC ..... *E01F 9/629* (2016.02); *E01F 9/608* (2016.02); *E04H 12/2238* (2013.01); *E04H 12/2292* (2013.01); *E01F 9/617* (2016.02)

(58) Field of Classification Search

CPC ... E01F 9/60; E01F 9/602; E01F 9/623; E01F 9/627; E04H 12/2238; E04H 12/2292

USPC ..... 404/9, 10; 116/63 R

See application file for complete search history.

(56) References Cited

U.S. PATENT DOCUMENTS

| | | | | | |
|---|---|---|---|---|---|
| 3,193,230 | A * | 7/1965 | Crankshaw | E01F 9/627 | 248/583 |
| 4,364,688 | A * | 12/1982 | Bitvai | E01F 9/692 | 404/10 |
| 4,958,954 | A * | 9/1990 | Schmanski | E01F 9/692 | 256/1 |
| 4,986,406 | A * | 1/1991 | Winsor | G07F 17/248 | 194/350 |
| 5,197,819 | A * | 3/1993 | Hughes | E01F 9/681 | 116/63 R |
| 5,205,236 | A * | 4/1993 | Hughes | E01F 9/629 | 116/209 |
| 5,277,146 | A * | 1/1994 | Hughes, Jr. | E01F 9/65 | 116/175 |
| 5,452,965 | A * | 9/1995 | Hughes, Sr. | E01F 9/608 | 404/10 |

(Continued)

*Primary Examiner* — Abigail A Risic

(74) *Attorney, Agent, or Firm* — Bracewell LLP; Brad Y. Chin

(57) ABSTRACT

A traffic control assembly, which includes a reinforced mounting base selectively mountable adjacent a roadway, a primary flexible tubular member, a reinforcing member, a retaining member, and a retaining pin. In accordance with at least one embodiment, the primary flexible tubular member is coupled to the reinforcing member, where the reinforcing member is configured to provide elastic support to the primary flexible tubular member against an impact by a moving vehicle. In accordance with at least one embodiment, the primary flexible tubular member is coupled to a structural insert on the opposite end from the base, the structural insert is further coupled to a secondary flexible tubular member to increase the resiliency of the traffic control assembly against an impact by a moving vehicle.

14 Claims, 10 Drawing Sheets

(56) References Cited

U.S. PATENT DOCUMENTS

| | | | | |
|---|---|---|---|---|
| 7,520,694 | B2 * | 4/2009 | Dvoracek | E01F 9/619 404/10 |
| 7,722,286 | B2 * | 5/2010 | Heald | E04H 12/2269 40/612 |
| 7,849,617 | B2 * | 12/2010 | Intagliata | E01F 9/629 248/160 |
| 8,202,020 | B2 * | 6/2012 | Hughes, Jr. | E01F 9/681 116/63 R |
| 8,348,545 | B1 * | 1/2013 | Hughes, Jr. | E01F 9/681 40/608 |
| 9,528,231 | B2 * | 12/2016 | Hughes, Jr. | E01F 9/60 |
| 10,006,178 | B2 * | 6/2018 | Intagliata | E01F 9/608 |
| 10,161,091 | B2 * | 12/2018 | Gunter | E01F 9/654 |
| 2008/0131201 | A1 * | 6/2008 | Audet | E01F 9/623 404/10 |
| 2009/0279951 | A1 * | 11/2009 | Wheeler, Jr. | E05D 7/0423 404/10 |
| 2010/0254761 | A1 * | 10/2010 | Wheeler, Jr. | E05D 7/0423 404/10 |
| 2014/0270939 | A1 * | 9/2014 | Intagliata | E01F 9/608 404/9 |
| 2016/0040374 | A1 * | 2/2016 | Shin | E01F 9/681 404/10 |
| 2016/0138229 | A1 * | 5/2016 | Hughes, Jr. | E01F 9/60 404/13 |

* cited by examiner

TRAFFIC CONTROL MARKER INCLUDING A REINFORCING MEMBER

CROSS REFERENCE TO RELATED APPLICATION

This application is related to, and claims priority to, U.S. Provisional Patent Application Ser. No. 62/633,189, filed on Feb. 21, 2018, the entire disclosure of which is incorporated by reference herein.

BACKGROUND

Field

Embodiments generally relate to a traffic control device or marker (hereinafter collectively referred to as a "traffic control marker") for highway and/or roadway systems. More particularly, various embodiments are directed to a traffic control marker including a reinforcing member.

Description of the Related Art

Many modern highway and roadway systems utilize traffic control markers, also known as guide posts, delineators, and stakes, to provide a variety of indications to motorists. Generally, traffic control markers can be used to mark the boundaries of roadways or to indicate special access lanes, such as toll lanes or high-occupancy vehicle lanes, though other uses also exist. Some areas of the highway, such as shoulder areas and zones that buffer cars from hazards routinely use traffic control markers to indicate to motorists that these areas are not safe to drive in. Typically, the traffic control marker includes a reflective sheeting partially or completely surrounding the primary tube to provide a distinct indication to motorists at night or through a construction zone. A vehicle's lights reflect off the reflective material on the traffic control marker, thereby indicating to the motorists they should not cross the boundary indicated by the marker.

Generally speaking, traffic control markers are designed and manufactured to survive multiple impacts by vehicles of varying sizes and speeds. One type of traffic control marker is a flexible delineator highway marker, which typically includes a flexible insert positioned in a primary tube of the highway marker to provide it with a rebound effect. In particular, the insertion of the flexible insert into the primary tube of the highway marker allows the marker to return to a substantially upright position after being struck and deflected by a moving vehicle. However, after surviving multiple impact events, a damaged traffic control marker may no longer return to a substantially upright position. If so, motorists may not identify the traffic control marker.

Such a traffic control marker features many parts and requires multiple steps to properly assemble and install the flexible insert into the primary tube, which is subsequently attached to a mounting base of the traffic control marker. Additionally, each of the parts included in such a device is naturally subject to wear over time, requiring the disassembly of multiple parts to repair the damaged traffic control marker.

Thus, it would be desirable to provide a traffic control marker, or flexible delineator highway marker, with a reinforcing member to enhance the structural integrity of the outer or primary tube to prevent it from detaching or deforming from the traffic control marker on impact by a moving vehicle, to improve the functioning life of the traffic control marker, and to maintain the performance of known types of flexible highway markers, when vehicles deflect them on the roadway or other marking area. Such a marker would provide safer roadways for motorists and also provide a cost benefit by reducing the routine service and replacement expenses for traffic control markers.

SUMMARY

Embodiments are directed to a traffic control assembly, which includes a base selectively mountable adjacent a roadway, a primary flexible tubular member positioned in a recess in the base, a reinforcing member, and a retaining member. In accordance with at least one embodiment, the reinforcing member, when coupled to the primary flexible tubular member, is configured to protect the primary flexible tubular member from deformation during a vehicle impact event. In accordance with at least one embodiment, the retaining member, when positioned in a recess in the base, is configured to secure the primary flexible tubular marker and the reinforcing member to the base.

In accordance with at least one embodiment, the reinforcing member includes an upper portion and a lower portion. In accordance with at least one embodiment, the reinforcing member includes at least one substantially circumferential cavity positioned on the upper portion formed by a plurality of substantially circumferential crests, configured to provide the primary flexible tubular member elastic support perpendicular from a side of the primary flexible tubular member. In accordance with at least one embodiment, the at least one substantially circumferential cavity and the primary flexible tubular member are substantially concentric. In accordance with at least one embodiment, heights of the plurality of substantially circumferential crests may vary.

In accordance with at least one embodiment, the lower portion of the reinforcing member is configured to mate with the interior surfaces of the retaining member. In accordance with at least one embodiment, the lower portion further comprises a shoulder configured to provide a better mate with the retaining member. In accordance with at least one embodiment, exterior surfaces of the retaining member are configured to mate with interior surfaces of the base.

In accordance with at least one embodiment, the reinforcing member includes a plurality of through holes spaced around a portion of the lower surface.

In accordance with at least one embodiment, each of the base, the primary flexible tubular member, the reinforcing member, and the retaining member includes a plurality of apertures configured to receive a retaining pin therethrough.

In accordance with at least one embodiment, the primary flexible tubular member includes at least one tab configured to reinforce and support the retaining pin, when the retaining pin is inserted through the pair of apertures in the primary flexible tubular member.

In accordance with at least one embodiment, the primary flexible tubular member includes a lower flange. In accordance with at least one embodiment, the lower flange is mountable below the reinforcing member.

In accordance with at least one embodiment, the lower flange includes an upper step and a lower step. In accordance with at least one embodiment, the upper step of the lower flange includes at least one tab configured to engage a cut-out portion in the interior of the reinforcing member, when the reinforcing member is slid down around the primary flexible tubular member to engage a lower flange of the primary flexible tubular member positioned in the recess of the base.

In accordance with at least one embodiment, the primary flexible tubular member includes a first aperture having a circular shape on a front side of the primary flexible tubular member and a second aperture having an elongated shape in the vertical direction on a back side of the primary flexible tubular member.

In accordance with at least one embodiment, the traffic control assembly further includes a flexible core arranged inside the primary flexible tubular member and configured to be secured in the base.

In accordance with at least one embodiment, the flexible core further includes a pair of apertures configured to receive the retaining pin therethrough.

In accordance with at least one embodiment, the traffic control assembly further includes a structural insert, the structural insert comprising a bottom end and a top end. In accordance with at least one embodiment, the bottom end is configured to be inserted into and secured onto the primary flexible tubular member opposite from the base. In accordance with at least one embodiment, the top end of the structural insert is configured to be inserted into and secured onto a secondary flexible tubular member.

In accordance with at least one embodiment, the structural insert includes a mid-flange positioned between the bottom end and the top end of the structural insert, wherein the mid-flange is configured to engage the primary flexible tubular member.

In accordance with at least one embodiment, the structural insert further includes a pair of apertures, where the primary flexible tubular member includes a plurality of retention elements, the retention elements being configured to engage the pair of apertures to secure the structural insert to the primary flexible tubular member. In accordance with at least one embodiment, the secondary flexible tubular member includes a plurality of retention elements, the retention elements being configured to engage the pair of apertures to secure the secondary flexible tubular member to the structural insert.

In accordance with at least one embodiment, the traffic control assembly further includes a flexible outer tube including a pair of apertures, where the primary flexible tubular member includes a plurality of retention elements, the retention elements being configured to engage the pair of apertures to secure the flexible outer tube to the primary flexible tubular member.

In accordance with at least one embodiment, the flexible outer tube includes a reflective component. In an alternate embodiment, the reflective element can be replaced by an alternate reflective material, a light emitting diode, an array of light emitting diodes, or other illumination sources.

BRIEF DESCRIPTION OF DRAWINGS

So that the manner in which the features and advantages of the invention, as well as others which will become apparent, may be understood in more detail, a more particular description of the invention briefly summarized above may be had by reference to the embodiments thereof that are illustrated in the appended drawings, which form a part of this specification. It is to be noted, however, that the drawings illustrate only various embodiments of the invention and are therefore not to be considered limiting of the invention's scope as it may include other effective embodiments as well.

DETAILED DESCRIPTION

Although the following detailed description contains many specific details for purposes of illustration, it is understood that one of ordinary skill in the relevant art will appreciate that many examples, variations, and alterations to the following details are within the scope and spirit of the invention. Accordingly, the various embodiments described herein are set forth without any loss of generality, and without imposing limitations, relating to the claimed invention. Like numbers refer to like elements throughout.

Referring to FIGS. 1-10, embodiments of a traffic control assembly are shown. A traffic control device, traffic control, assembly, roadside marker, or flexible delineator 100 (hereinafter collectively referred to as "traffic control assembly 100") for marking roadways or other marking areas is shown.

Figure 1:
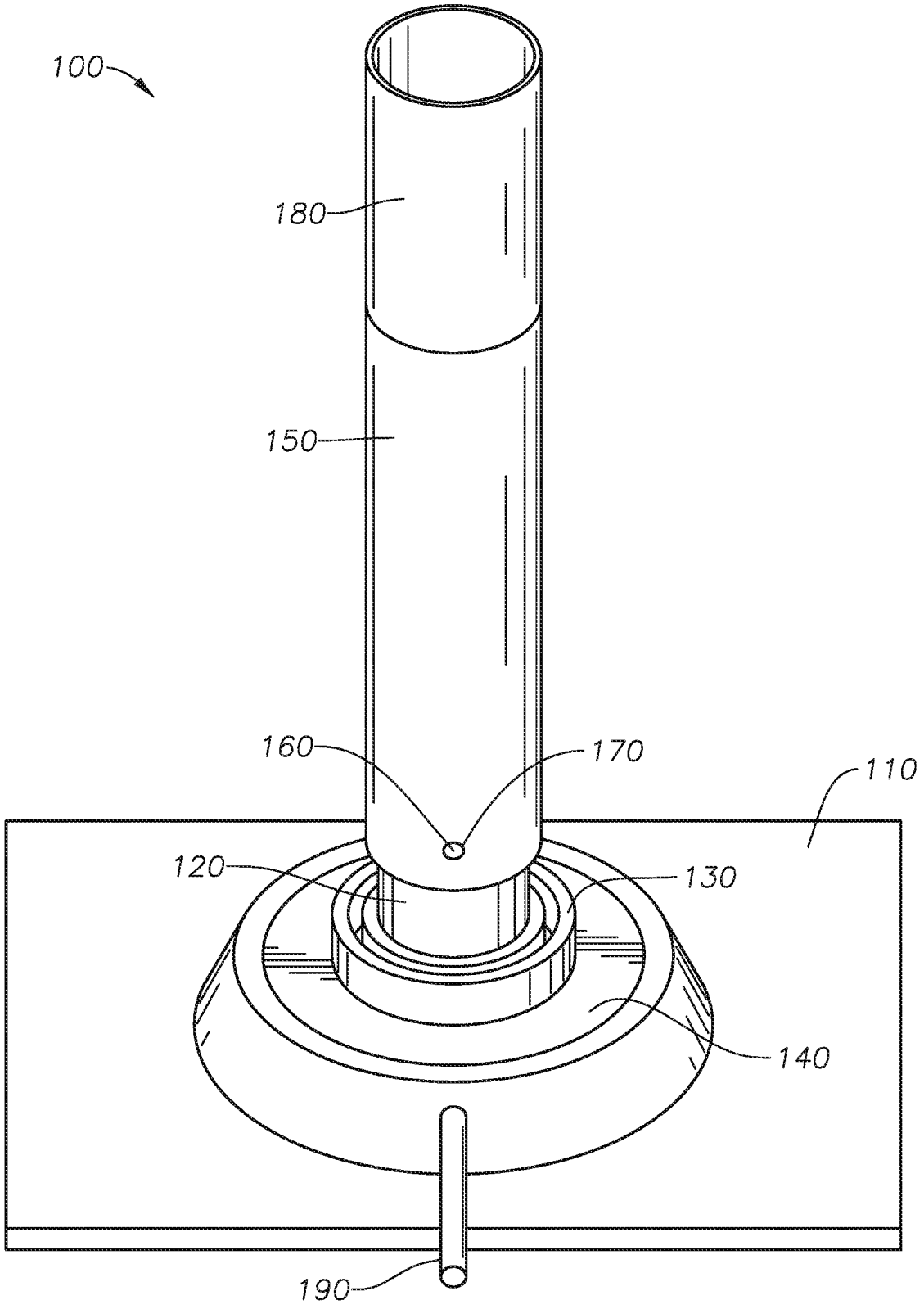
FIG. 1 is an isometric view of a traffic control assembly, in accordance with an embodiment.

As shown in FIG. 1, the traffic control assembly 100, in accordance with at least one embodiment, includes a base 110, and a flexible marker or primary tube 120 (hereinafter referred to as "primary member 120") that extends substantially vertically from the base 110, when the primary member 120 is in a non-impacted and non-deformed state (i.e., not impacted or deformed by a moving vehicle). In accordance with at least one embodiment, the base 110 can attach to asphalt, concrete, or other hard surfaces, and serves as a mounting point by which the primary member 120 may be secured to the ground. In accordance with at least one embodiment, the primary member 120 is sufficiently thick to resist casual bending or flexing along its length from forces, for example, a strong wind. As such, the primary member 120 remains substantially vertically upright, when the primary member 120 is in a non-impacted and non-deformed state. The primary member 120 is sufficiently flexible, so that it will elastically deform along its length, when a physical object forcibly applies a significant impact thereto, for example, by a moving vehicle or automobile.

As further shown in FIG. 1, the traffic control assembly 100 includes a reinforcing member 130 and a retaining member 140.

In accordance with at least one embodiment, as shown in FIG. 1, the base 110 includes a cylindrical and conical shape, while in at least one other embodiment, the base is configured in the shape of a square or rectangle (not shown), or alternatively any other suitable shape. These various shapes may be suitable for uneven terrain to better stabilize the traffic control assembly 100, when the surface of the supporting ground is not level. For example, on a roadway having a sloped shoulder, the base 110 having an elongated shape (e.g., oval with a size of, for example, 4 inches by 18 inches), with a long side of the base 110 being parallel to the roadway, may be used to better follow the contour of the shoulder in which the traffic control assembly 100 is located. The base 110 having a round shape, as shown in FIG. 1, will be discussed in more detail below.

As further shown in FIG. 1, when the traffic control assembly 100 is assembled, the reinforcing member 130 is positioned in a recess in the base 110 and is coupled with the primary member 120. The retaining member 140 is also positioned in a recess in the base 110 to secure a base of the reinforcing member 130 coupled with the primary member 120.

As further shown in FIG. 1, the traffic control assembly 100 includes a flexible outer tube 150. In accordance with at least one embodiment, the flexible outer tube 150 includes a pair of apertures 160 and the primary member 120 includes a plurality of retention elements 170. In accordance with at least one embodiment, the flexible outer tube 150 is secured to the primary member 120. In accordance with at least one embodiment, the flexible outer tube 150 can be of materials with varying thicknesses depending on the desirable characteristics of the traffic control assembly 100. Often though, the flexible outer tube 150 is made from plastic due to its low cost and impact durability. Also, the flexible outer tube 150 will often be made in a vibrant color to aide in the visibility of the marker, at least during the day.

As further shown in FIG. 1, the traffic control assembly 100 includes a reflective component 180. In accordance with at least one embodiment, the reflective component 180 can be made of a reflective sheet material. In an alternate embodiment, the reflective component 180 can be replaced by an alternate reflective material, a light emitting diode, an array of light emitting diodes, or other illumination source that will alert a vehicle to the presence of the traffic control assembly 100. In a light emitting embodiment, the base 110 or other portion of the traffic control assembly 100 can be configured with solar panels and a battery can be housed inside the traffic control assembly 100, such that the traffic control assembly 100 can generate enough electricity during the day to keep them illuminated at night. In an alternate embodiment, the solar panels and/or batteries can be displaced from the traffic control assembly 100. Additionally, in each of the above described embodiments, an illumination source can be placed in the protected inner section of the traffic control assembly 100, such that the lights can be protected from vehicle impacts and can continue to function after an impact or number of impacts. In an embodiment, the lower end of a traffic control assembly 100 can be configured to be embedded in the roadway and the reflective material and protected portion of reflective materials can be configured to face towards oncoming traffic. In an embodiment, the illuminative or light configured section of a traffic control assembly 100 can be configured to face towards oncoming traffic.

As further shown in FIG. 1, the traffic control assembly 100 includes a retaining pin 190. In accordance with at least one embodiment, the retaining pin 190 is inserted through a plurality of apertures in the base 110, the primary member 120, the reinforcing member 130, and the retaining member 140 to secure these elements of the traffic control assembly 100 to one another.

In accordance with at least one embodiment, as shown in FIG. 1, the retaining pin 190 is formed with a length that allows it to extend in one side of the base 110, through the retaining member 140, through the reinforcing member 130, through the primary member 120, and out the other side of the base 110. The retaining pin 190 further includes a handle to permit a user to insert and remove the retaining pin 190 with ease.

Figure 2A:
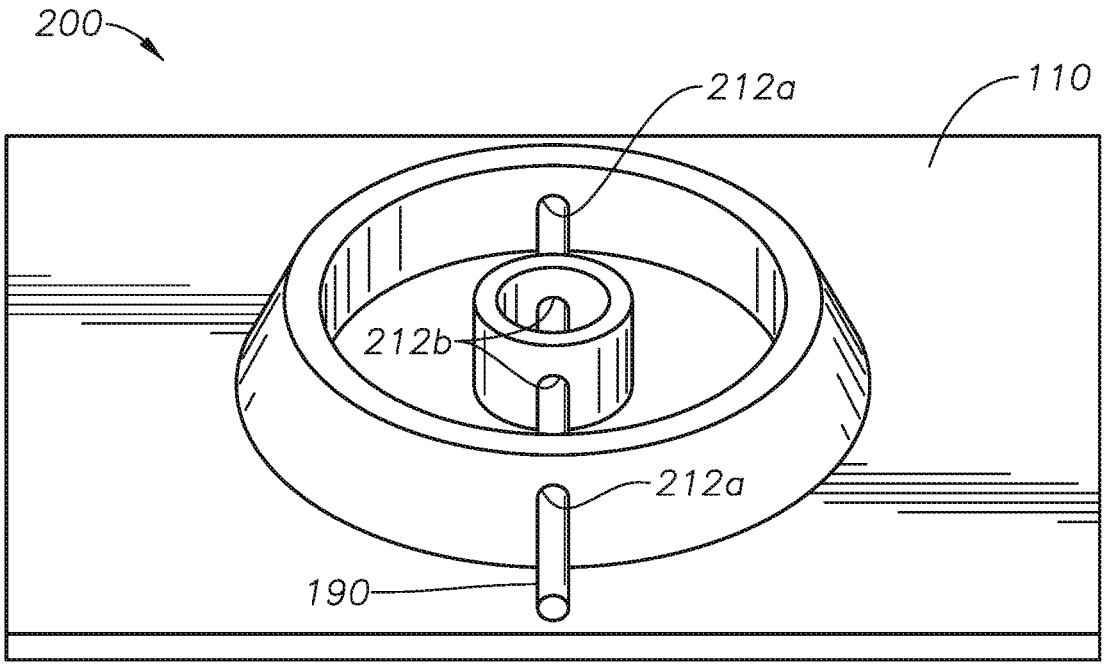
FIGS. 2A-2C are exploded isometric views of the traffic control assembly shown in FIG. 1, in accordance with various embodiment.
Figure 2B:
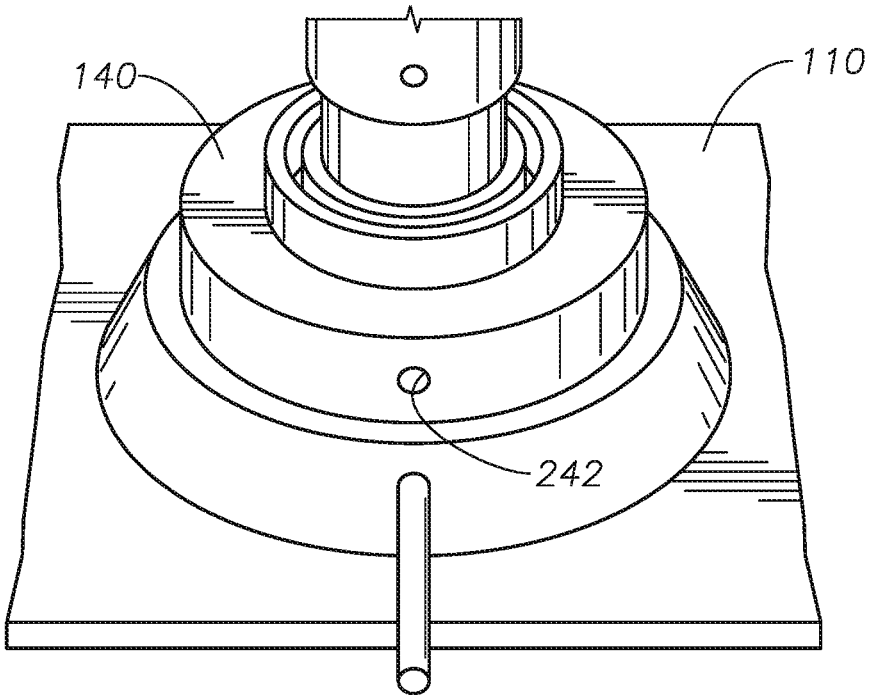
Figure 2C:
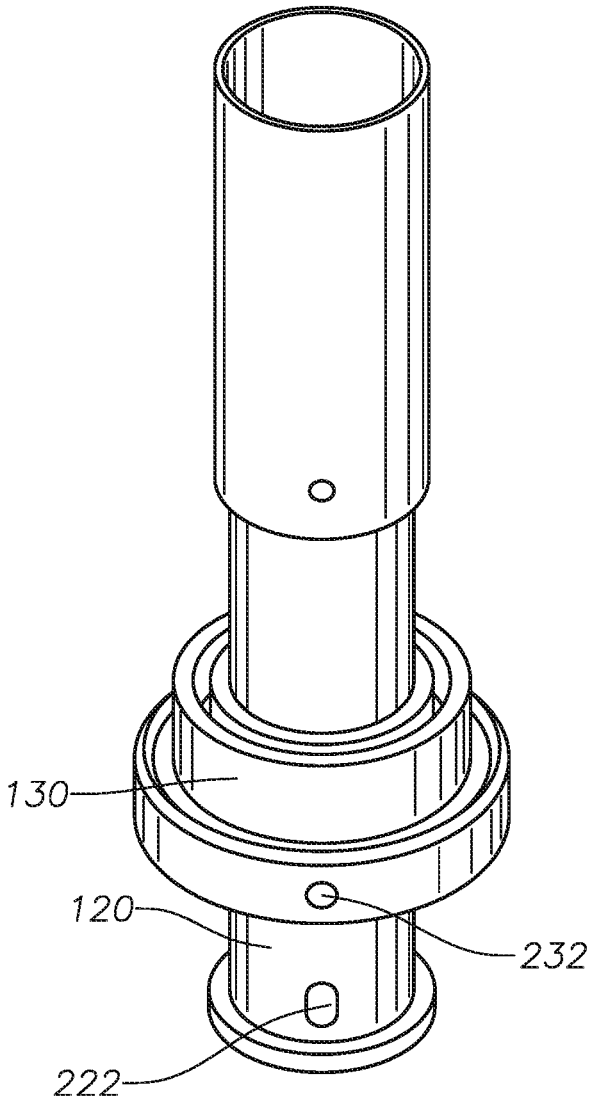

FIGS. 2A-2C are exploded isometric views of the lower portion of the traffic control assembly 100 shown in FIG. 1, in accordance with various. As shown in FIGS. 2A-2C, the traffic control assembly 100, in accordance with at least one embodiment, includes the base 110, the primary member 120, the reinforcing member 130, the retaining member 140, and the retaining pin 190. As briefly discussed with respect to FIG. 1, each of the base 110, the primary member 120, the reinforcing member 130, and the retaining member 140 includes a plurality of apertures configured to receive the retaining pin 190 therethrough. For example, the base 110 includes a pair of apertures 212*a*, 212*b*, the primary member 120 includes a pair of apertures 222, the reinforcing member 130 includes a pair of apertures 232, and the retaining member 140 includes a pair of apertures 242.

In accordance with at least one embodiment, the base 110 includes four apertures, where two apertures 212*a* are positioned in opposing sides of an outer portion of the base 110 and two apertures 212*b* are positioned in opposing sides of an inner portion of the base 110 (i.e., spaced 180° from one another, respectively), such that all four apertures are aligned with one another to receive the retaining pin 190. Similarly, the primary member 120 includes two apertures 222 positioned in opposing sides of the primary member 120, where the two apertures 222 are in alignment with one another to receive the retaining pin 190 therethrough. In accordance with at least one embodiment, as will be discussed in more detail below, one aperture 222 in the primary member 120 has a circular shape, and the other aperture 222 in the primary member 120 has an elongated shape in the vertical direction.

As further shown in FIG. 2C, the reinforcing member 130, according to at least one embodiment, includes two apertures 232 in opposing sides of the reinforcing member 130 (i.e., spaced 180° from one another, respectively). As further shown in FIG. 2B, in accordance with at least one embodiment, the retaining member 140 includes two apertures 242 in opposing sides of the retaining member (i.e., spaced 180° from one another, respectively).

In accordance with at least one embodiment, the traffic control assembly 200 is arranged, such that the retaining pin 190 orientation is perpendicular against the impact direction of the moving vehicle. The traffic control assembly 200, according to various embodiments, having this configuration provides non-obvious advantages over conventional traffic control markers with respect to maintaining the resiliency of the primary member 120 coupled with the reinforcing member 130 and anchoring the primary member 120 coupled with the reinforcing member 130 to the traffic control assembly 200.

Figure 3B:
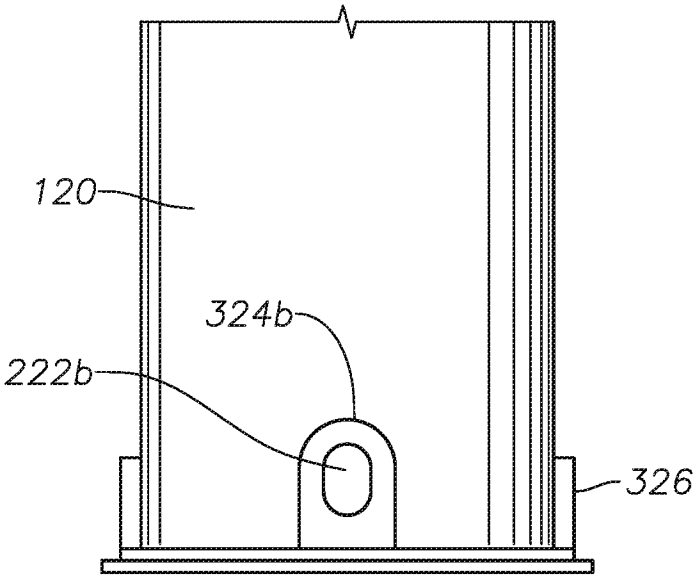
FIGS. 3A and 3B are side views of the primary flexible tubular member of the traffic control assembly shown in FIGS. 1 and 2A-2C, in accordance with an embodiment.
Figure 3A:
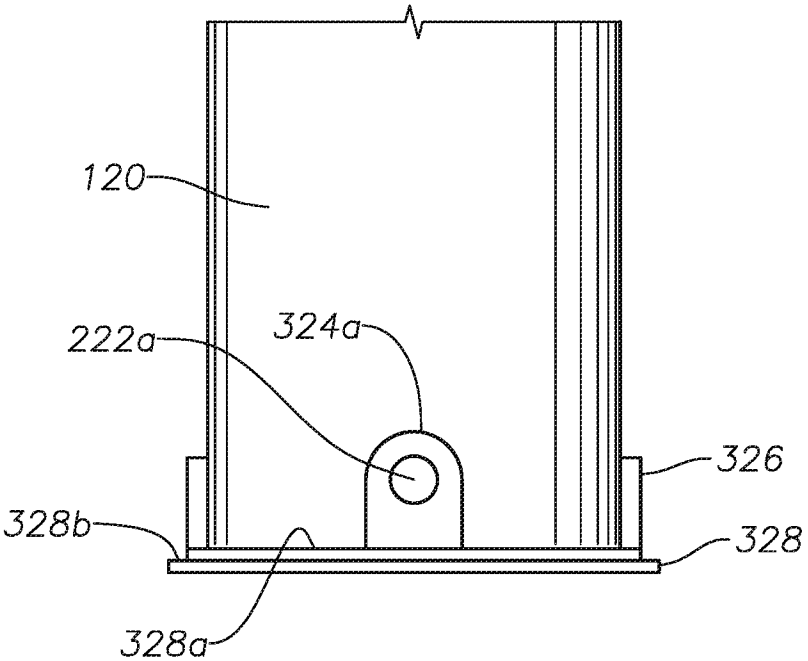

FIGS. 3A and 3B are side views of the primary member of the traffic control assembly shown in FIGS. 1 and 2A-2C, in accordance with an embodiment. In accordance with at least one embodiment, each aperture 222*a*, 222*b* in the primary member 120 has a corresponding first tab 324*a*, 324*b*, respectively, extending outwards from the side of the primary member 120. In accordance with at least one embodiment, each of the one first tabs 324*a*, 324*b* reinforces and supports the retaining pin (not shown), when the retaining pin is inserted through the apertures 222*a*, 222*b* of the primary member 120.

In accordance with at least one embodiment, the primary member 120 further includes at least one second tab 326 oriented, for example, 90 degrees on either side of one of the at least one first tab 324*a*, 324*b* of the primary member 120. The at least one second tab 326 is arranged to align with a respective protrusion (not shown) extending from the surface of the reinforcing member (not shown) to serve as alignment elements and further reinforce the connection between the elements of the traffic control assembly.

In accordance with at least one embodiment, the primary member 120 further includes a lower flange 328, wherein the lower flange 328 is configured to be positioned below the reinforcing member (not shown). In accordance with at least one embodiment, the lower flange 328 includes an upper step 328*a* and a lower step 328*b*. In accordance with at least one embodiment, the at least one first tab 324*a*, 324*b* does not protrude beyond the diameter of the upper step 328*a*. In accordance with at least one embodiment, the at least one second tab 326 does not protrude beyond the diameter of the upper step 328*a*.

In accordance with at least one embodiment, each of the at least one first tab 324*a*, 324*b* and the at least one second tab 326 is made of plastic, although one of ordinary skill in the relevant art would have understood that these tabs could be made from other materials, which have a durability that would prevent each of these tabs from ripping, when the traffic control assembly is impacted by, for example, a moving vehicle.

As further shown in FIGS. 3A and 3B, in accordance with at least one embodiment, one aperture 222*a*, as shown in FIG. 3A, in the primary member 120 has a circular shape, and the other aperture 222*b*, as shown in FIG. 3B, in the primary member 120 has an elongated, in the vertical direction shape. In accordance with at least one embodiment, the retaining pin (not shown) is inserted into the aperture 222*a*, through the traffic control assembly, and out of the aperture 222*b*. As one of ordinary skill in the relevant art would have understood, embodiments contemplate aperture 222*a* having an elongated, in the vertical direction shape and aperture 222*b* having a circular shape.

Figure 4:
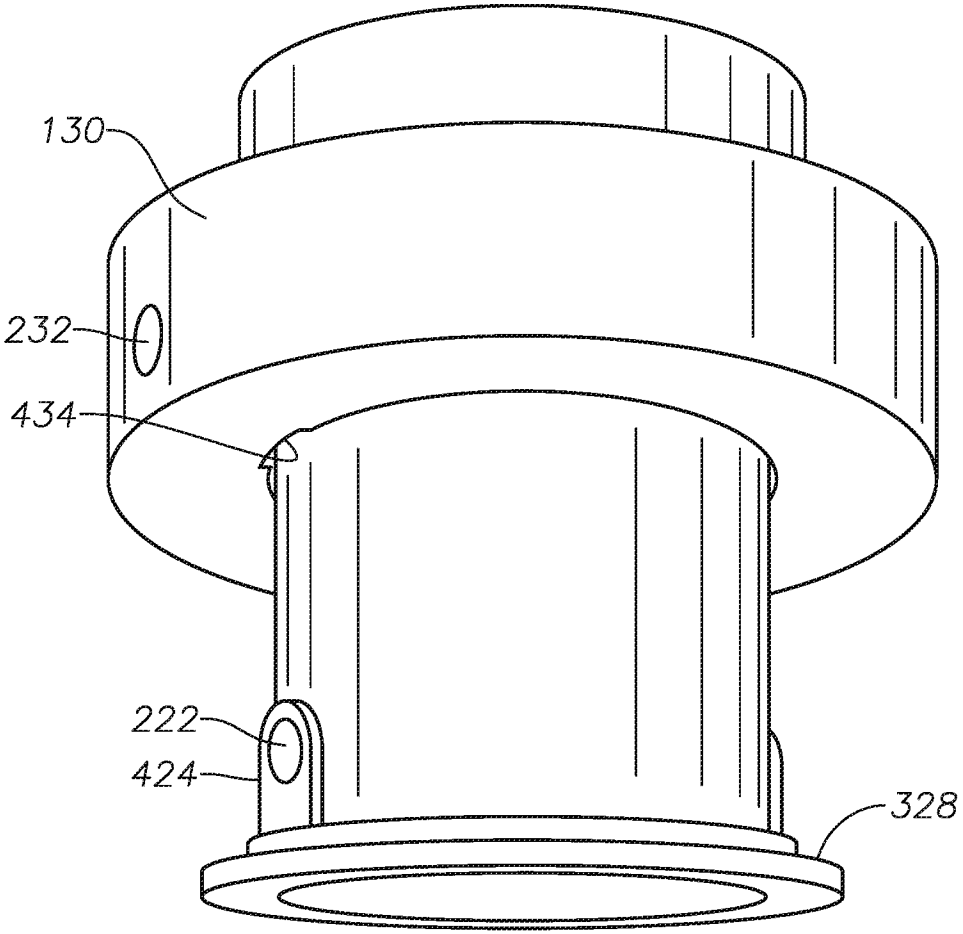
FIG. 4 is a perspective view of the reinforcing member and the primary flexible tubular member of the traffic control assembly shown in FIGS. 1 and 2A-2C, in accordance with an embodiment.

FIG. 4 is a perspective view of the reinforcing member and the primary member of the traffic control assembly shown in FIGS. 1 and 2A-2C, in accordance with an embodiment. In accordance with at least one embodiment, an interior surface of the reinforcing member 130 includes at least one first cut-out portion 434 having the same shape as the at least one first tab 424 of the primary member 120, such that, when the reinforcing member 130 is placed over and around the primary member 120 and slid down around the primary member 120 to engage a lower flange 328 of the primary member 120, for example, in the recess of the base (not shown), the apertures 222 and 232 are in alignment with one another, so that the retaining pin (not shown) can be inserted therethrough. Hence, the at least one first tab 424 and the at least one first cut-out portion 434 serve as alignment elements and further reinforce the connection between these elements of the traffic control assembly. In accordance with at least one embodiment, the interior surface of the reinforcing member 130 includes at least one second cut-out portion (not shown) having the same shape as the at least one second tab 424 of the primary member 120, such that, when the reinforcing member 130 is placed over and around the primary member 120 and slid down around the primary member 120 to engage a lower flange 428 of the primary member 120, for example, in the recess of the base (not shown), the apertures 222 and 232 are in alignment with one another, so that the retaining pin (not shown) can be inserted therethrough. Hence, the at least one second tab (not shown) and the at least one second cut-out portion (not shown) serve as alignment elements and further reinforce the connection between these elements of the traffic control assembly.

Figure 5:
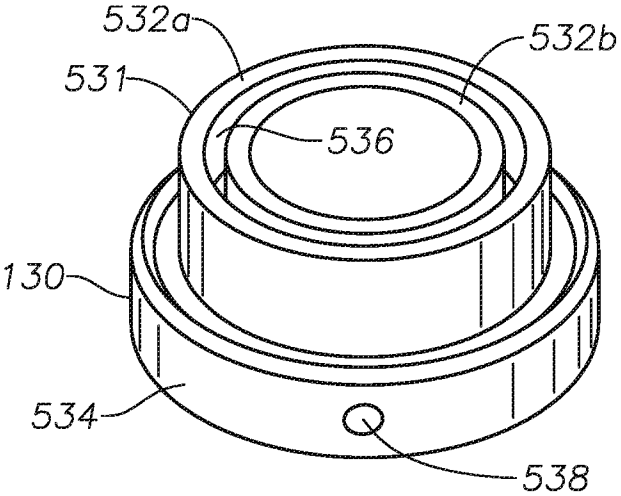
FIG. 5 is a isometric view of the reinforcing member shown in FIGS. 1 and 2A-2C, in accordance with an embodiment.

FIG. 5 is a isometric view of the reinforcing member shown in FIGS. 1 and 2A-2C, in accordance with an embodiment. In accordance with at least one embodiment, the reinforcing member 530 includes an upper portion 531 and a lower portion 534. The upper portion 531 includes at least one substantially circumferential cavity 536 formed by a plurality of substantially circumferential crests. In accordance with at least one embodiment, the lower portion 534 is configured to mate with the interior surfaces of the retaining member (not shown).

As further shown in FIG. 5, according to at least one embodiment, the reinforcing member 130 includes an outer substantially circumferential crest 532*a* and an inner substantially circumferential crest 532*b*. The at least one substantially circumferential cavity 536 is formed as a result of the inner diameter of the outer substantially circumferential crest 532*a* being greater than the outer diameter of the inner substantially circumferential crest 532*b*. In accordance with at least one embodiment, more than one substantially circumferential cavities (not shown) is formed by more than two substantially circumferential crests (not shown). In accordance with at least one embodiment, heights of individual crests forming the plurality of substantially circumferential crests may vary.

In accordance with at least one embodiment, the reinforcing member 130 includes a plurality of through holes 538 spaced around the lower portion 534 for enhanced mounting to the base (not shown).

Figure 6:
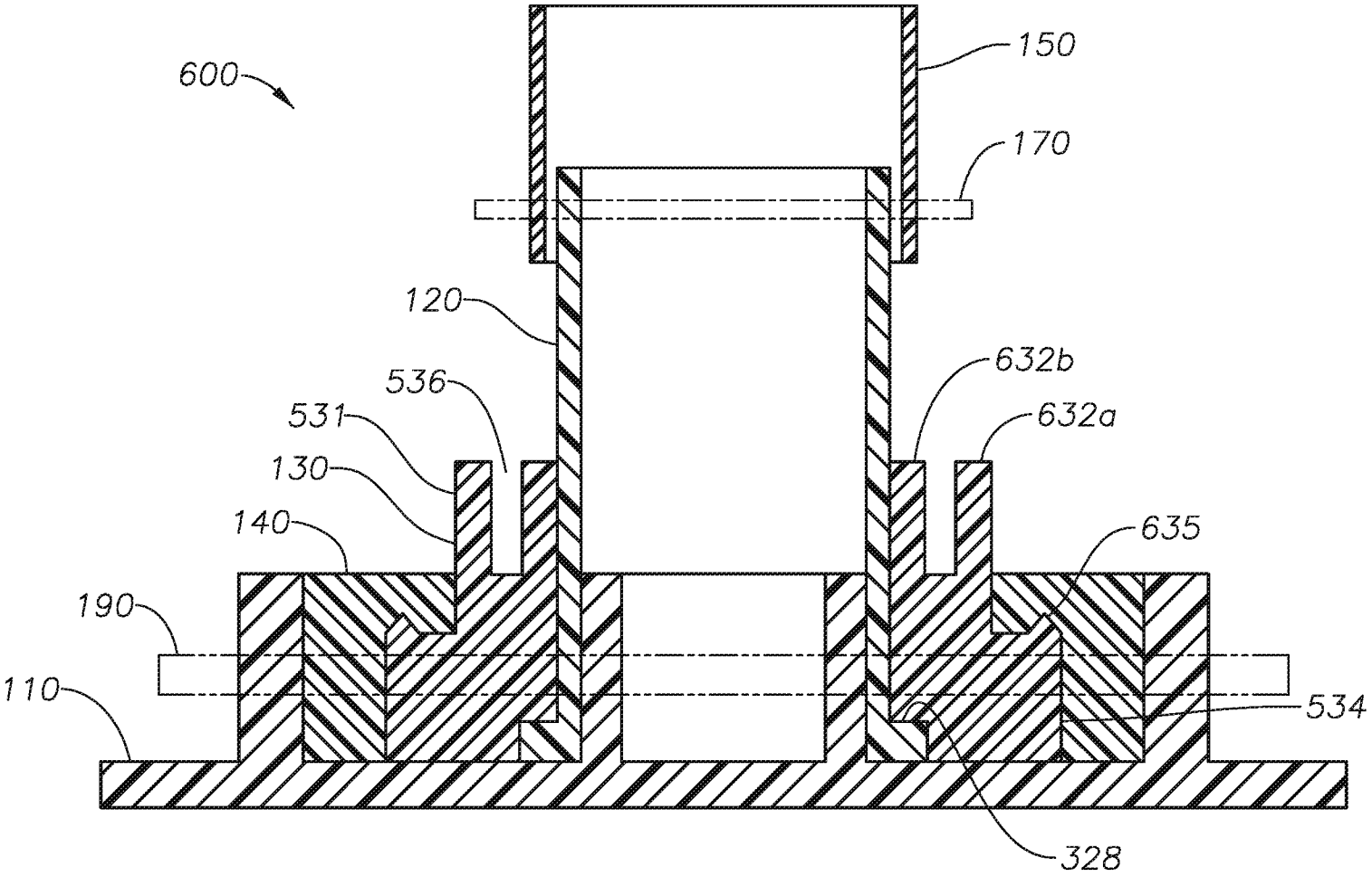
FIG. 6 is a cross-sectional view of the base assembly of the traffic control assembly shown in FIGS. 1 and 2A-2C wherein the base is engaging the retaining member, the retaining member is engaging the reinforcing member, and the reinforcing member is engaging the primary flexible tubular member of the traffic control assembly, in accordance with an embodiment.

FIG. 6 is a cross-sectional view of the base assembly of the traffic control assembly shown in FIGS. 1 and 2A-2C, wherein the base is engaging the retaining member, the retaining member is engaging the reinforcing member, and the reinforcing member is engaging the primary member of the traffic control assembly, in accordance with an embodiment.

As shown in FIG. 6, the traffic control assembly 600, in accordance with at least one embodiment, includes the base 110, the primary member 120, the reinforcing member 130, and the retaining member 140. In accordance with at least one embodiment, when the traffic control assembly 600 is assembled, the primary member 120, the reinforcing member 130, and the retaining member 140 is positioned in a recess in the base 110. In accordance with at least one embodiment, the primary member 120 is coupled with the reinforcing member 130. In accordance with at least one embodiment, the retaining member 140 secures the reinforcing member 130, coupled with the primary member 120 to the base 110. In accordance with at least one embodiment, the interior of the retaining member 140 is configured to mate with the lower portion 534 of the reinforcing member 130. In accordance with at least one embodiment, the exterior of the retaining member 140 is configured to mate with the interior of the base 110. In accordance with at least one embodiment, the lower portion 534 of the reinforcing member 130 is configured to include a shoulder 635 such that the retaining member 140 locks the reinforcing member 130.

As further shown in FIG. 6, according to at least one embodiment, the primary member 120 has a lower flange 328, such that the primary member 120 is positioned below the reinforcing member 130. In accordance with at least one embodiment, the upper portion 631 of the reinforcing member 130 includes at least one substantially circumferential cavity 636 and a plurality of substantially circumferential crests.

As further shown in FIG. 6, according to at least one embodiment, the upper portion 531 of the reinforcing member 130 includes an outer substantially circumferential crest 632*a* and an inner substantially circumferential crest 632*b*. The at least one substantially circumferential cavity 536 is formed as a result of the inner diameter of the outer substantially circumferential crest 632*a* being greater than the outer diameter of the inner substantially circumferential crest 632*b*. In accordance with at least one embodiment, more than one substantially circumferential cavities (not shown) is formed by more than two substantially circumferential crests (not shown). In accordance with at least one embodiment, heights of individual crests (e.g., heights of the outer substantially circumferential crest 632*a* and the inner substantially circumferential crest 632*b*), forming the plurality of substantially circumferential crests 632*a*, 632*b* may vary. In accordance with at least one embodiment, the at least one substantially circumferential cavity 536 and the primary member 120 are substantially concentric.

In accordance with at least one embodiment, the primary member 120 is sufficiently thick to resist casual bending or flexing along its length from forces, for example, a strong wind. As such, the primary member 120 remains substantially vertically upright, when the primary member 120 is in a non-impacted and non-deformed state. The primary member 120 is sufficiently flexible, so that it will elastically deform along its length, when a physical object forcibly applies a significant impact thereto, for example, by a moving vehicle or automobile.

Although the primary member 120 by itself is sufficiently thick to resist casual bending while being sufficiently flexible enough to maintain a substantially upright position after a vehicle impact event, in accordance with at least one embodiment, the at least one substantially circumferential cavity 536 is configured to provide the primary member 120 additional elastic support perpendicular from a side of the primary member 120. In accordance with at least one embodiment, the force of a moving vehicle impacting the traffic control assembly 600 cause the inner substantially circumferential crest 632*b*, coupled with the primary member 120, to bend towards the outer substantially circumferential crest 632*a* then bounce back to its initial substantially upright position.

The traffic control assembly 600, according to various embodiments, having this configuration has non-obvious advantages over conventional traffic control markers with respect to resiliency of the primary member 120 coupled with the reinforcing member 130 and anchoring the primary member 120 coupled with the reinforcing member 130 to the traffic control assembly. In other words, a traffic control assembly 600 having the at least one circumferential cavity 536 can be struck many more times than conventional traffic control markers, which do not have such feature. Such a traffic control assembly 600 provides safer roadways for motorists and also provides a cost benefit by reducing the routine service and replacement expenses for traffic control markers. Markers can be deployed in the hundreds or thousands along highway and roadway sections and thus the added safety benefits and service cost reductions can be substantial.

As further shown in FIG. 6, and as briefly discussed with respect to FIGS. 1 and 2A-2C, according to at least one embodiment, each of the base 110, the primary member 120, the reinforcing member 130, and the retaining member 140 includes a plurality of apertures configured to receive the retaining pin 190 therethrough.

As further shown in FIG. 6, and as briefly discussed with respect to FIG. 1, according to at least one embodiment, the traffic control assembly 600 includes a flexible outer tube 150. In accordance with at least one embodiment, the flexible outer tube 150 includes a pair of apertures and the primary member 120 includes a plurality of retention elements 170. In accordance with at least one embodiment, the flexible outer tube 150 is secured to the primary member 120.

Figure 7:
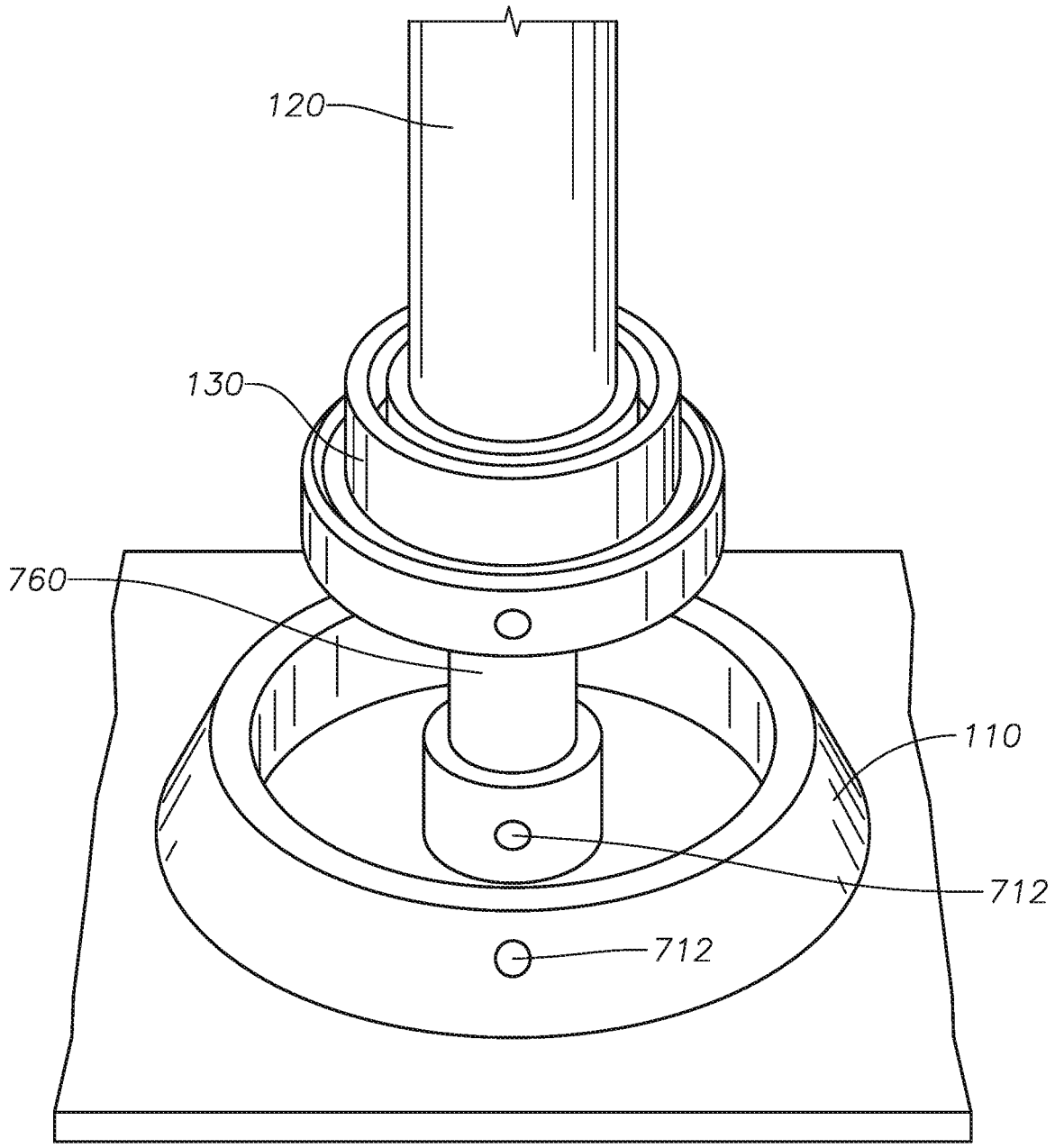
FIG. 7 is an exploded isometric view of the traffic control assembly, in accordance with an embodiment.

FIG. 7 is an exploded isometric view of the traffic control assembly, in accordance with an embodiment. To improve the elastic properties of the primary member 120 coupled with the reinforcing member 130, a flexible core 760 can be arranged inside the primary member 120. In accordance with at least one embodiment, the flexible core 760 is formed from a resilient material, for example, rubber, as a non-limiting example. As further shown in FIG. 7, the flexible core 760 is configured to be secured in the base 110, and includes a pair of apertures 712 to receive the retaining pin (not shown) therethrough. In accordance with another embodiment, the flexible core 760 is arranged inside the primary member 120, but is not secured in the base 110, as previously described (i.e., the flexible core 760 is removably placed inside the primary member 120).

Figure 8:
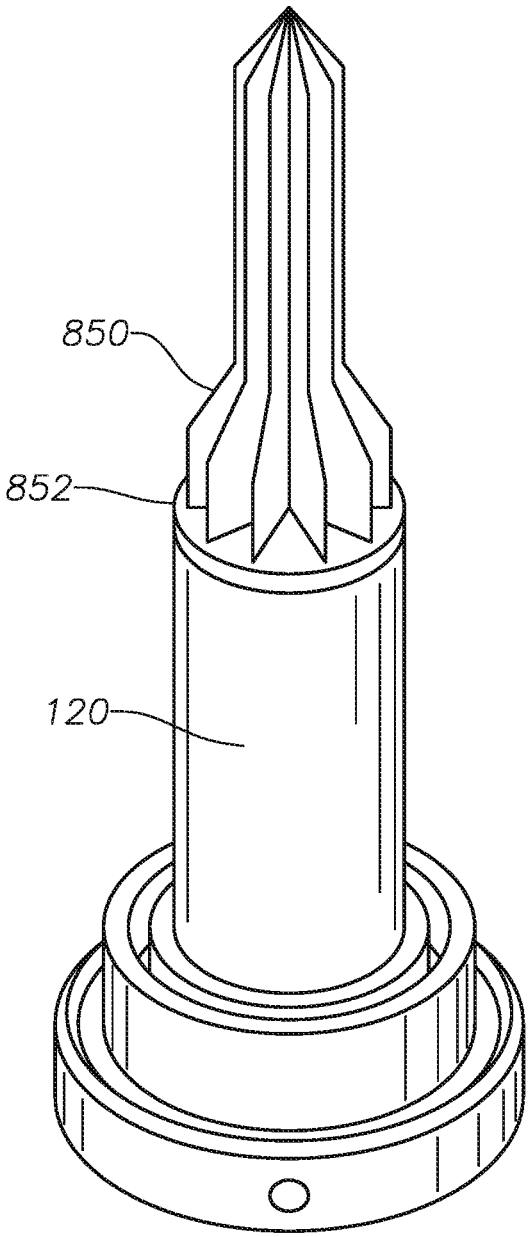
FIG. 8. is an isometric view of another traffic control assembly shown in FIGS. 1 and 2A-2C, in accordance with an embodiment.

FIG. 8. is an isometric view of another traffic control assembly shown in FIGS. 1 and 2A-2C, in accordance with an embodiment. In accordance with at least one embodiment, a structural insert 850 includes a bottom end and a top end, and the bottom end is configured to be inserted into the primary member 120 opposite from the base (not shown). In accordance with at least one embodiment, the structural insert 850 includes a mid-flange 852 positioned between both ends of the structural insert 850, configured to limit the amount of insertion into the primary member 120.

Figure 9A:
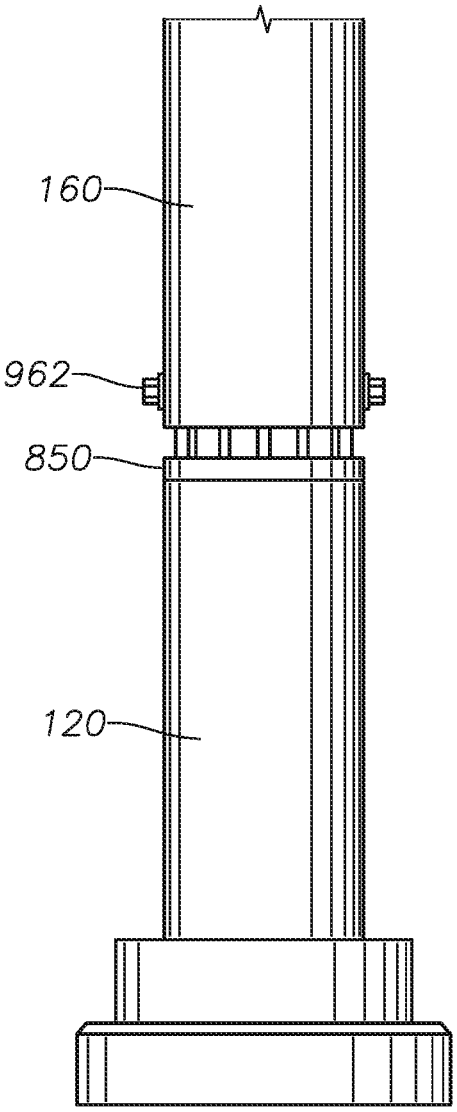
FIGS. 9A and 9B are side views of another traffic control assembly, as shown in FIG. 8, in accordance with an embodiment.
Figure 9B:
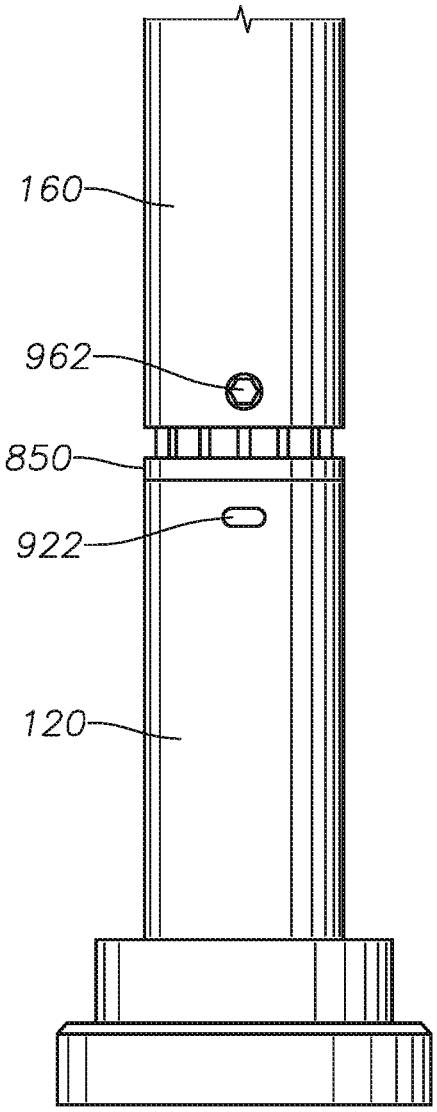

FIGS. 9A and 9B are side views of another traffic control assembly, as shown in FIG. 8, in accordance with an embodiment. In accordance with at least one embodiment, the bottom end of the structural insert 850 is configured to be inserted into the primary member 120, where the top surface of the primary member 120 is in contact with the bottom surface of the mid-flange of the structural insert 850. In accordance with at least one embodiment, the top end of the structural insert 850 is configured to be inserted into a secondary flexible tubular member 160 (hereinafter referred to as "secondary member 160"). In accordance with at least one embodiment, the bottom surface of the secondary member 160 is not in contact with the top surface of the mid-flange of the structural insert 850. In alternate embodiments, the bottom surface of the secondary member 160 is in contact with the top surface of the mid-flange.

As further shown in FIGS. 9A and 9B, according to at least one embodiment, the structural insert 850 further includes a pair of apertures (not shown). The primary member 120 includes a pair of apertures 922 and a plurality of retention elements (not shown), such that the retention elements are configured to engage the pair of apertures to secure the structural insert 850 to the primary member 120. In accordance with at least one embodiment, the secondary member 160 includes a plurality of retention elements 962, such that the retention elements 962 are configured to engage the pair of apertures to secure the secondary member 160 to the structural insert 850.

Figure 10:
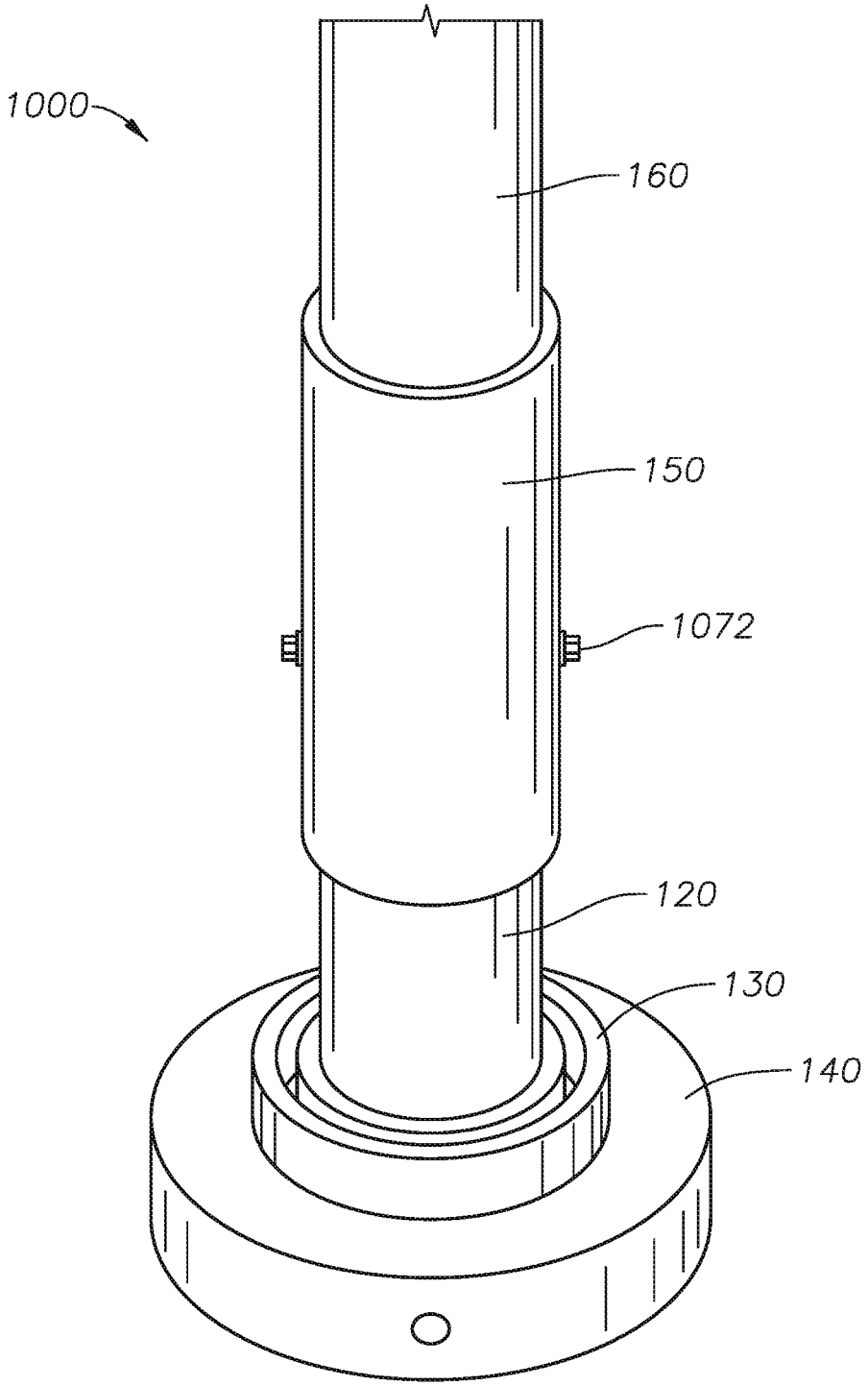
FIG. 10 is a perspective view of another traffic control assembly, in accordance with an embodiment.

FIG. 10 is a perspective view of another traffic control assembly, in accordance with an embodiment. In accordance with at least one embodiment, the primary member 120 is supported by the reinforcing member 130, where the retaining member 140 secures the primary tube 120 coupled with the reinforcing member 130 to the base (not shown). In accordance with at least one embodiment, one end of the structural insert (not shown) is configured to be inserted into the primary member 120 and the other end is configured to be inserted into the secondary member 160. In accordance with at least one embodiment, the structural insert (not shown) includes a pair of apertures (not shown) and the primary member 120 includes a plurality of retention elements (not shown), where the retention elements are configured to secure the structural insert to the primary member 120. In accordance with at least one embodiment, the structural insert (not shown) includes a pair of apertures (not shown) and the secondary member 160 includes a plurality of retention elements (not shown), wherein the retention elements are configured to secure the secondary member 160 to the structural insert. In accordance with at least one embodiment, the traffic control assembly 1000 further includes a flexible outer tube 150, where the flexible outer tube 150 includes a pair of apertures (not shown). In accordance with at least one embodiment, the primary member 120 includes a plurality of retention elements 1072, where the retention elements 1072 are configured to engage the pair of apertures to secure the flexible outer tube 150 to the primary member 120.

As further shown in FIG. 10, in accordance with at least one embodiment, the traffic control assembly 1000 is arranged, such that the retention elements 1072 orientation is perpendicular against the impact direction of the moving vehicle. The traffic control assembly 1000, according to various embodiments of the invention, having this configuration provides non-obvious advantages over conventional traffic control markers with respect to maintaining the resiliency of the primary member 120 coupled with the structural insert (not shown) and the secondary member 160.

Other marker body configurations may be substituted into the various embodiments described herein as would be understood by one of ordinary skill in the art.

The present invention may suitably comprise, consist or consist essentially of the elements disclosed and may be practiced in the absence of an element not disclosed. For example, it can be recognized by those skilled in the art that certain structural elements can be combined into a single structural element.

Unless defined otherwise, all technical and scientific terms used have the same meaning as commonly understood by one of ordinary skill in the art to which this invention belongs.

The singular forms "a," "an," and "the" include plural referents, unless the context clearly dictates otherwise.

As used herein and in the appended claims, the words "comprise," "has," and "include" and all grammatical variations thereof are each intended to have an open, non-limiting meaning that does not exclude additional elements or steps.

As used herein, terms such as "first" and "second" or "primary" and "secondary" are arbitrarily assigned and are merely intended to differentiate between two or more components of an apparatus. It is to be understood that the words "first" and "second" or "primary" and "secondary" serve no other purpose and are not part of the name or description of the component, nor do they necessarily define a relative location or position of the component. Furthermore, it is to be understood that the mere use of the term "first" and "second" or "primary" and "secondary" does not require that there be any "third" or "tertiary" component, although that possibility is contemplated under the scope of the embodiments of the present invention.

Ranges may be expressed herein as from about one particular value, and/or to about another particular value. When such a range is expressed, it is to be understood that another embodiment is from the one particular value and/or to the other particular value, along with all combinations within said range.

Although the various embodiments have been described in detail, it should be understood that various changes, substitutions, and alterations can be made hereupon without departing from the principle and scope of the various embodiments. Accordingly, the scope of the various embodiments should be determined by the following claims and their appropriate legal equivalents.

What is claimed is:

1. A traffic control assembly, comprising:

a base, the base selectively mountable adjacent a roadway;

a primary flexible tubular member, the primary flexible tubular member positioned in a recess in the base;

a reinforcing member, the reinforcing member coupled to the primary flexible tubular member and arranged circumferentially around an outer surface of the primary flexible tubular member;

a retaining member, the retaining member coupled to the reinforcing member, positioned in the recess of the base, and arranged circumferentially around an outer surface of the reinforcing member; and a retaining pin, wherein the reinforcing member is configured to protect the primary flexible tubular member from deformation during a vehicle impact event, wherein the retaining member, when positioned in the recess in the base, is configured to secure the flexible tubular member and the reinforcing member to the base, and wherein the retaining pin is inserted through a plurality of apertures in the base, the retaining member, the reinforcing member, and the primary flexible tubular member.

2. The traffic control assembly of claim 1, wherein the reinforcing member comprises a plurality of substantially circumferential crests, the plurality of substantially circumferential crests configured to form at least one substantially circumferential cavity, wherein the at least one substantially circumferential cavity is configured to provide the primary flexible tubular member elastic support.

3. The traffic control assembly of claim 1, wherein the primary flexible tubular member comprises a first aperture having a circular shape on a front side of the primary flexible tubular member and a second aperture having an elongated shape in the vertical direction on a back side of the primary flexible tubular member, wherein the retaining pin is inserted into the first aperture and out of the second aperture.

4. The traffic control assembly of claim 3, wherein the primary flexible tubular member comprises at least one tab configured to reinforce and support the retaining pin.

5. The traffic control assembly of claim 1, wherein the primary flexible tubular member comprises a lower flange.

6. The traffic control assembly of claim 5, wherein the lower flange comprises an upper step and a lower step, the upper step comprises at least one tab, the reinforcing member comprises at least one cut-out portion, wherein the at least one tab of the primary flexible tubular member is configured to engage the at least one cut-out portion of the reinforcing member, when the reinforcing member is slid down around the primary flexible tubular member to engage the lower flange of the primary flexible tubular member positioned in the recess of the base.

7. The traffic control assembly of claim 1, further comprising:

a flexible core, the flexible core arranged inside the primary flexible tubular member and configured to be secured in the base.

8. The traffic control assembly of claim 1, further comprising:

a flexible core, the flexible core arranged inside the primary flexible tubular member and configured to be secured in the base, wherein the flexible core further comprises a pair of apertures configured to receive the retaining pin therethrough.

9. The traffic control assembly of claim 1, further comprising:

a flexible outer tube, the flexible outer tube comprising a pair of apertures, wherein the primary flexible tubular marker comprises a plurality of retention elements, the retention elements being configured to engage the pair of apertures to secure the flexible outer tube to the flexible tubular member.

10. The traffic control assembly of claim 9, wherein the flexible outer tube comprises a reflective component.

11. The traffic control assembly of claim 1, further comprising:

a structural insert, the structural insert comprising a bottom end and a top end; and a secondary flexible tubular member, wherein the bottom end is configured to be inserted into the primary flexible tubular member opposite from the base, and wherein the top end is configured to be inserted into the secondary flexible tubular member.

12. The traffic control assembly of claim 11, wherein the structural insert comprises a mid-flange positioned between the bottom end and a top end.

13. The traffic control assembly of claim 11, wherein the structural insert further comprises a pair of apertures, wherein the primary flexible tubular member comprises a plurality of retention elements, the plurality of retention elements being configured to engage the pair of apertures to secure the structural insert to the primary flexible tubular member.

14. The traffic control assembly of claim 11, wherein the structural insert further comprises a pair of apertures, wherein the secondary flexible tubular member comprises a plurality of retention elements, the retention elements being configured to engage the pair of apertures to secure the secondary flexible tubular member to the structural insert.

* * * * *